United States Patent [19]

Arzola

[11] 4,127,962

[45] Dec. 5, 1978

[54] WHISTLE HAVING ANGULARLY JOINED CYLINDRICAL CHAMBERS

[76] Inventor: Rurico Arzola, Calle San Martin, No. 69-Urb. Villa Sol, Mayaguez, P.R. 00708

[21] Appl. No.: 785,524

[22] Filed: Apr. 7, 1977

Related U.S. Application Data

[63] Continuation-in-part of Ser. No. 600,503, Jul. 31, 1975.

[51] Int. Cl.[2] ..... G10K 5/00

[52] U.S. Cl. ..... 46/179

[58] Field of Search ..... 46/178, 179, 180, 181, 46/44, 175 R

[56] References Cited

U.S. PATENT DOCUMENTS

| | | | |
|---|---|---|---|
| 838,187 | 12/1906 | Hoops | 46/178 |
| 1,154,672 | 9/1915 | Tikijian | 46/179 |
| 3,066,443 | 12/1962 | Mobley | 46/180 X |
| 3,785,335 | 1/1974 | Wagner | 46/181 R |

FOREIGN PATENT DOCUMENTS

| | | | |
|---|---|---|---|
| 17349 | 2/1882 | Fed. Rep. of Germany | 46/179 |
| 312598 | 11/1933 | Italy | 46/179 |

*Primary Examiner*—F. Barry Shay
*Attorney, Agent, or Firm*—Craig and Antonelli

[57] ABSTRACT

A musical whistle instrument is provided having resonant chambers, at least one of which may be filled with a fluid, and a tubular member for introducing pulses of air into the resonant chamber. This structure produces many musical sounds imitating melodious bird sounds of various bird species. A method for operation of the device is also described.

16 Claims, 7 Drawing Figures

WHISTLE HAVING ANGULARLY JOINED CYLINDRICAL CHAMBERS

Figure 1:
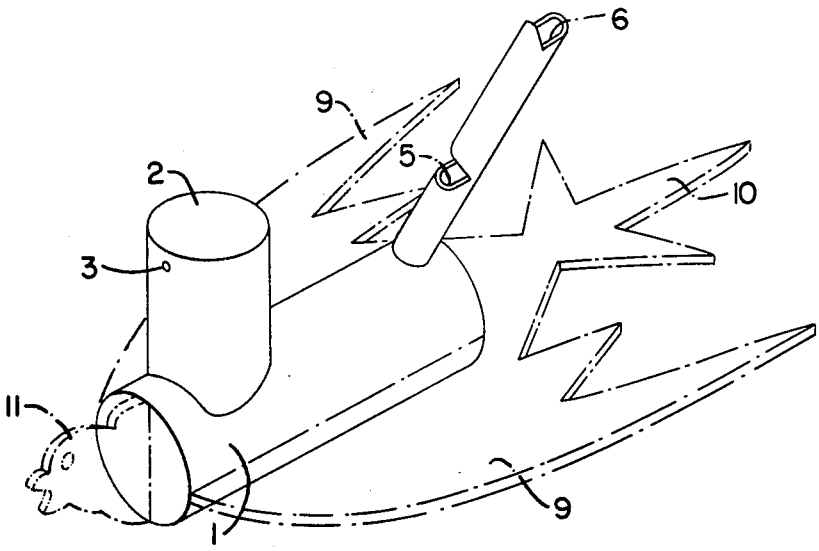

This is a continuation-in-part application of copending U.S. patent application, Ser. No. 600,503, filed July 31, 1975.

The present invention relates to a musical whistle or instrument for mimicking or imitating musical sounds of birds. With a suitable operation of this instrument, the sound of any kind of bird desired can be produced.

Thus, this instrument is advantageous in the instruction of science and biology courses, such as physics and ornithology, since the sounds of different birds can be reproduced in the classrooms without the necessity of out-of-doors field study. Students of ornithology can be introduced to and become familiar with the sounds of many different birds while in the laboratory or classroom. Moreover, this instrument may be useful in the production of background sound tracks in both movies and sound cassettes, and the structure of the present invention provides an interesting instrument which is completely entertaining by the reproduction of various whistles and musical sounds.

The mimicking bird instrument of the present invention achieves these desirable features by means of a construction having a central hollow chamber, which may be filled with water, together with an elongated mouthpiece being inserted at an angle into the central chamber for introduction of pulses of air. A second chamber is in further communication with the central hollow chamber with an extremely small opening therein, and these two chambers allow resonances of the air pulses, thereby producing the desired sounds. The mouthpiece structure includes a V-shaped opening intermediate of an aperture for the introduction of air pulses, and this aperture for introducing air pulses is also V-shaped. As a further construction of the device, wings of a bird, as well as the bird's head can be attached to the cylindrical member forming the central chamber such that an interesting appearance is achieved by the device.

To produce the musical sounds with this instrument, a fluid, such as water, is introduced into the central hollow chamber through the V-shaped aperture intermediate of the mouthpiece, with the fluid being introduced to a predetermined level within the chamber. When air pulses are introduced through the mouthpiece, a series of multiple sounds, which imitate a wide variety of different bird species from many countries are produced. The air pulses can be achieved by either blowing into the mouthpiece aperture, or by the use of small air compressors of various kinds to apply the air pulses to the mouthpiece aperture. To remove the water from the central chamber, the middle aperture in the mouthpiece is closed, such as by pressing thereon with a finger, and air is blown through the mouthpiece with the instrument being held upside down.

Accordingly, an object of the present invention is a musical instrument for providing whistles and sounds resembling those of many different varieties of birds.

A further object of the present invention is a method for operating this whistling instrument such that the various whistling and musical sounds can be achieved as desired.

Figure 2:
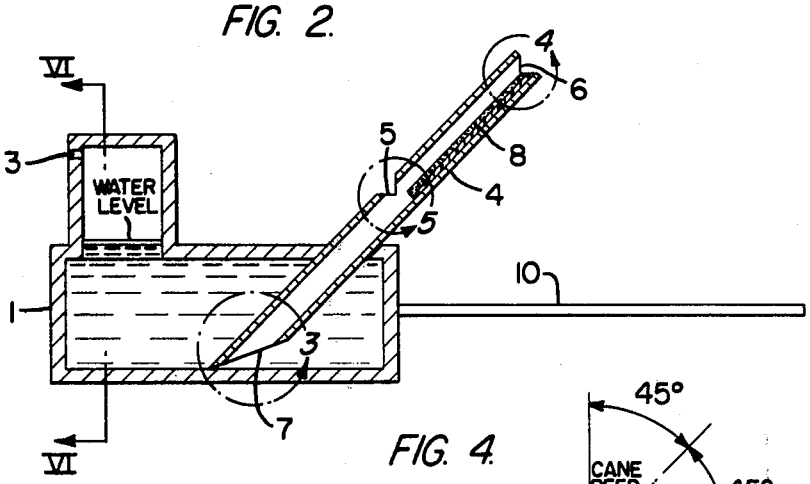
Figure 4:
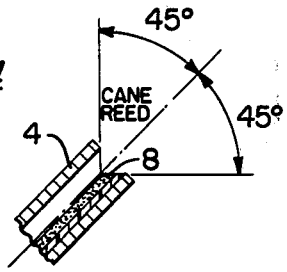
Figure 3:
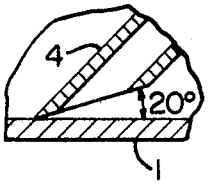
Figure 5:
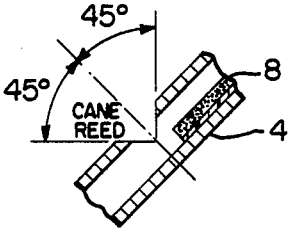
Figure 6:
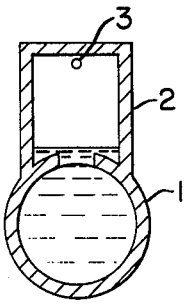
Figure 7:
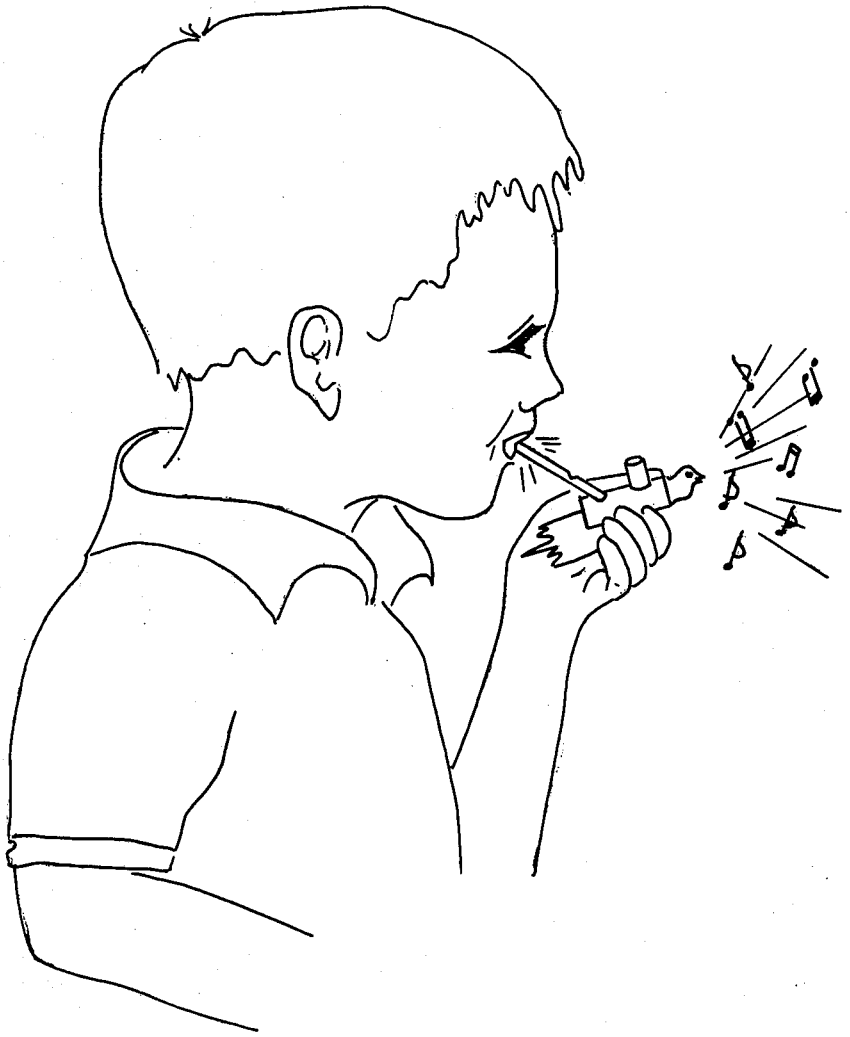

These and other objects of the present invention may be further understood by reference to the following non-limitative embodiments, as illustrated in the drawing figures, wherein FIG. 1 is an isometric view of the instrument of the present invention, FIG. 2 is a cross-sectional view of the structure of the present invention, FIG. 3 is a partial cross-sectional view of the details of FIG. 2, FIG. 4 is a further cross-sectional view of the details of FIG. 2, FIG. 5 is another cross-sectional view of the details of FIG. 2, FIG. 6 is a partial cross-sectional view through the section indicated by the arrows VI—VI in FIG. 2, and FIG. 7 illustrates an example of the use of the present invention.

As illustrated in the drawing figures, the mimicking bird instrument of the present invention is constructed with a closed, central hollow chamber 1, being in the form of a cylindrical member, and having a truncated cylinder 2 arranged at the cylindrical surface of the chamber 1 near one end thereof. This truncated cylinder 2 is also hollow and opens into the central chamber 1. A small diameter hole, in the range of 1/32 to 1/16 inch in diameter, is provided at a front portion of the truncated cylinder 2. This opening 3 allows inner air pressure to exit from the device, such that the respective chambers form resonances of the instrument.

A mouthpiece 4 is formed of an elongated cylinder being inserted through the cylindrical wall of the chamber 1 to a point near the interior of an opposite cylindrical wall of the chamber 1. The mouthpiece 4 is cut at this point at an angle 7 with respect to the interior surface of the chamber 1, and this angle 7 may be of about 20°. The mouthpiece is inserted into the cylindrical wall of the chamber 1 at an angle of about 45°, and includes an intermediate aperture 5, having a V-shaped cut through the side of the tubular mouthpiece 4. This V-configuration may be an approximately 90° angular cut. The end 6 of the mouthpiece 4 is also cut with a V-configuration, and may also have an approximately 90° angular cut.

A member 8 having the form of a reed is inserted within the mouthpiece 4 from the aperture end 6 to approximately the location of the intermediate aperture 5. This reed member may be of a cane wood, or can also be a plastic material. The member 8 is connected to the interior wall of the mouthpiece 4, such as by gluing or bonding with an appropriate bonding material.

The structure of the device may be formed in the configuration of a bird by the inclusion of wings 9 on either side of the central chamber 1 and a bird's head 11 at one end of the closed chamber 1. The tail configuration 10 of the bird may be formed as part of the wings 9. This structure may be made of plastic material, such as polyvinylchloride (PVC).

As an example of the construction of the present instrument, the cylindrical chamber 1 may be approximately 2 inches long with a 13/16 inch diameter. The thickness of the material may be 1/16 inch. The truncated cylinder 2 may have a height of 11/16, a diameter of ⅝ inch with a 1/16 inch thickness. As indicated above, the hole 3 may have a diameter of between 1/16 to 1/32 inch diameter. This hole 3 should preferably be located at the front part of the instrument and about ⅛ from the top to bottom.

The mouthpiece 4 may have a total length of 2 and 13/16 inches with a ¼ inch diameter. The mounting of the mouthpiece 4 into the cylinder may be at a 45° angle such that the mouthpiece 4 is inserted into the cylinder 1 to a distance of about 1 and 1/16 inches so that the remaining mouthpiece portion extends about 1 and ¾ inches from the exterior surface of the cylinder 1. The thickness of the tubular mouthpiece material may be about 1/32 inch.

The member 8 inserted into the mouthpiece 4 may be about 1 and ⅛ inches long to extend, at one end, oppositely the aperture 5. The member 8 is secured into the mouthpiece 4 to leave only a ⅛ to 3/32 inch space along the cylindrical tube of the mouthpiece 4, such that air will enter into this space enabling the production of the beautiful sounds and whistles of birds. It has been found that the smaller the space between the member 8 along its length and the inner wall of the mouthpiece 4, the better are the sounds that will be produced.

The operation of this device includes the introduction of fluid, such as water, into the central chamber 1, such as by introduction through the aperture 5. The chamber 1 is filled with the fluid to a level approximately at the level of the exterior cylindrical surface. Subsequently, blasts of air are introduced through the aperture 6 into the mouthpiece 4, thereby producing the whistles and melodies of the birds. Fluctuations in the air pulses produce mimicking of different birds in the sounds produced by the instrument.

The pulses of air, producing the mimicking bird sounds, may be achieved as by blowing into the mouthpiece 4, such as illustrated in FIG. 7, or can be achieved by use of a small compressor of various conventional types. A small can compressor of a bottled gas type, such as used for horns of automobiles, or other types of bottled gas containers that can be held by in the hand, can be used to produce a bird singing instrument. This air compressor should include control mechanisms to control the pulses of air introduced into the instrument such that the mimicking sounds of various birds can be produced as desired.

The operation of this instrument and the production of the various sounds involve the amount of fluid in the chamber 1, and different sounds, i.e. different resonances, can be achieved by varying the fluid level in the instrument. Moreover, even without any fluid in the chamber 1, whistling sounds are produced by the instrument.

While I have shown and described one embodiment in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A musical whistle comprising resonant chamber means for controlling resonances of air introduced into said chamber means, wherein said resonant chamber means includes a first elongated cylindrical chamber, said first chamber having a cylindrical wall being closed at opposite ends, and a truncated cylindrical chamber mounted in communication with said first chamber through a part of said cylindrical wall, said truncated chamber having a small aperture communicating the interior with the exterior; and means for introducing air pulses into said resonant chamber means to produce mimicking sounds of birds, wherein said means for introducing air pulses includes an elongated tubular member extending through said cylindrical wall of said first chamber to near an opposite interior cylindrical wall of said first chamber, said tubular member being open at respective ends, and including an intermediate aperture exterior to said first chamber, and said tubular member including an elongated member extending within said tubular member from the exterior open end to said intermediate aperture.

2. A whistle according to claim 1, wherein the end of said tubular member extending to near the interior wall of said first chamber is disposed angularly with respect to said interior wall.

3. A whistle according to claim 2, wherein the exterior end of said tubular member includes a V-configuration, of said intermediate aperture includes a V-configuration.

4. A whistle according to claim 3, wherein said elongated member extends from said V-configuration at said exterior end of said tubular member to opposite said intermediate aperture.

5. A whistle according to claim 4, wherein said V-configuration of said intermediate aperture has an angular cut at greater than 45°.

6. A whistle according to claim 4, wherein said elongated member is bonded to a portion of the interior surface of said tubular member.

7. A whistle according to claim 6, wherein said elongated member provides a narrowed passage space in said tubular member between said open end and said intermediate aperture.

8. A whistle according to claim 4, wherein said elongated member has a length of 1⅛ inches.

9. A whistle according to claim 1, wherein said elongated member is bonded to a portion of the interior surface of said tubular member.

10. A whistle according to claim 9, wherein said elongated member provides a narrowed passage space in said tubular member between said open end and said intermediate aperture.

11. A whistle according to claim 10, wherein said elongated member has a length of 1⅛ inches.

12. A whistle according to claim 1, wherein said first chamber contains liquid.

13. A whistle according to claim 12, wherein said liquid includes water completely filling said first chamber.

14. A whistle according to claim 1, wherein said means for introducing said air pulses includes container means for supplying compressed air to said means for introducing air pulses.

15. A method of operating the whistle of claim 1, comprising the steps of supplying a liquid into said resonant chamber means, introducing air pulses through said means for introducing said air pulses into said resonant chamber means, and controlling the introduction of said air pulses such that mimicking sounds of different birds are produced.

16. A whistle according to claim 15, wherein said step of supplying includes completely filling said first chamber with water.

* * * * *